United States Patent [19]

Redshaw

[11] 3,984,981

[45] Oct. 12, 1976

[54] ROTARY STIRLING ENGINE

[76] Inventor: Charles G. Redshaw, 15001 SE. 44th Place, Bellevue, Wash.

[22] Filed: Aug. 7, 1975

[21] Appl. No.: 602,923

[52] U.S. Cl. ..... 60/519; 60/525

[51] Int. Cl.[2] ..... F02G 1/04

[58] Field of Search ..... 60/517, 519, 525, 526

[56] References Cited

UNITED STATES PATENTS 3,815,362 6/1974 Kolbinger ..... 60/525

*Primary Examiner*—Allen M. Ostrager

[57] ABSTRACT

A rotary Stirling cycle engine wherein the rotors are utilized as internal heat exchangers and the displacers are utilized as heat regenerators. This engine in its simple configuration consists of two wedge-shaped spherical sectors connected by a disk-like universal type coupling within a spherical housing to form four variable displacement chambers. The sectors which contain passageways for conducting fluids through them are mounted as rotors on rotatable hollow shafts and are covered with fins to provide for the rapid transfer of heat between the conducted fluids and a working fluid contained within the chambers. The coupling which is also covered with fins to complement the rotors in the transfer of heat, contains passageways to interconnect the chambers into two pair and is constructed of porous heat absorbing material to transfer heat to and from the working fluid as it displaces the fluid from one interconnected chamber to the other.

9 Claims, 17 Drawing Figures

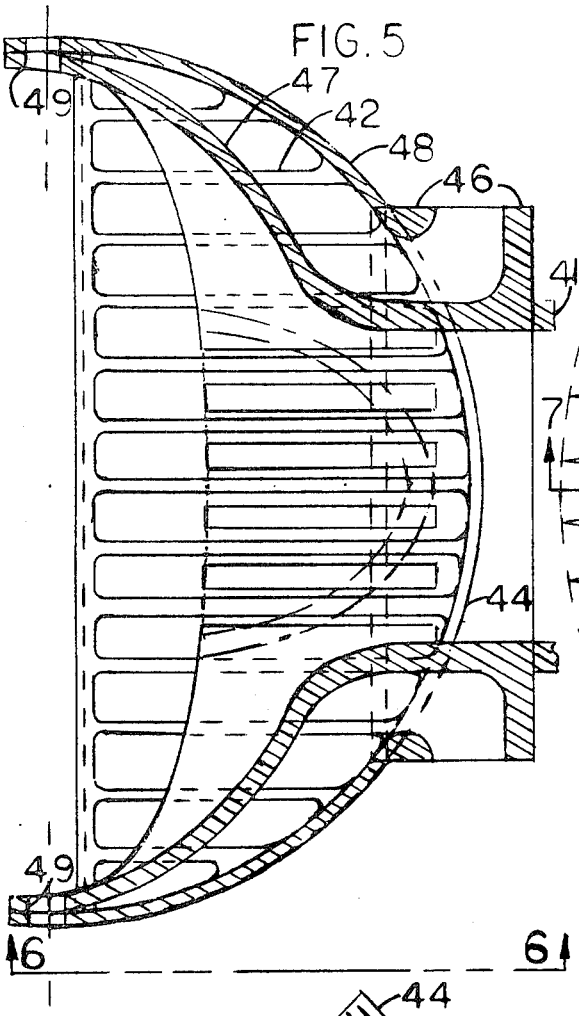
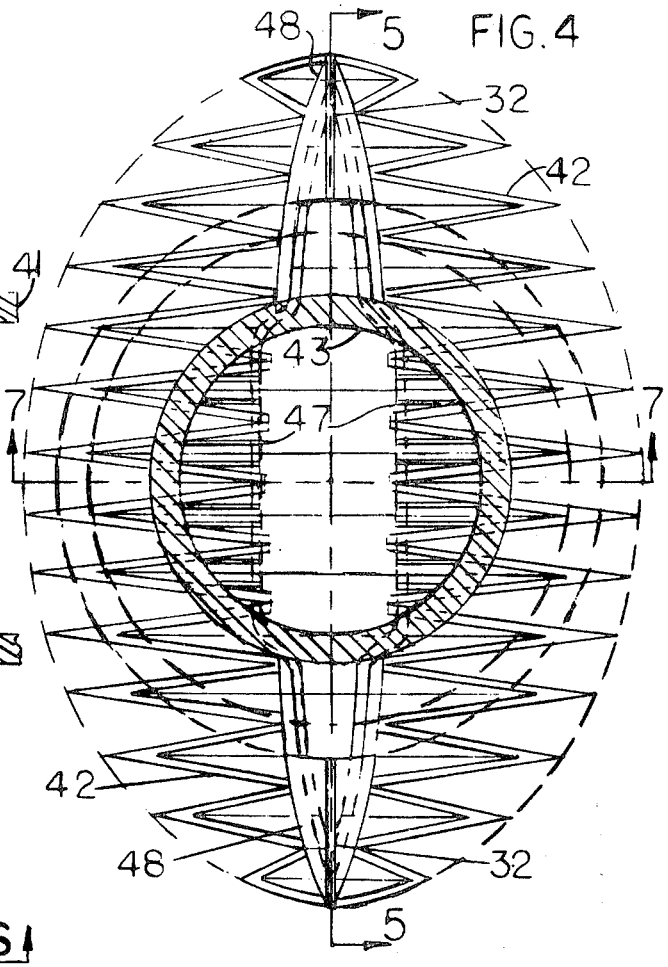
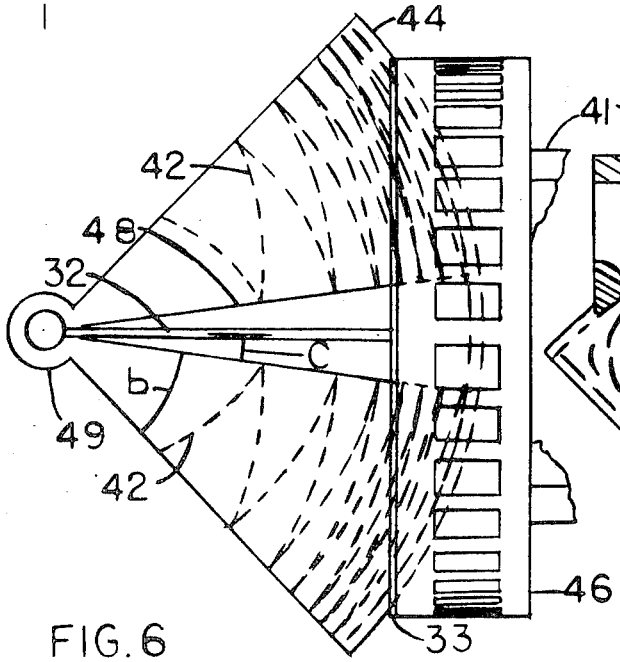
FIG. 6
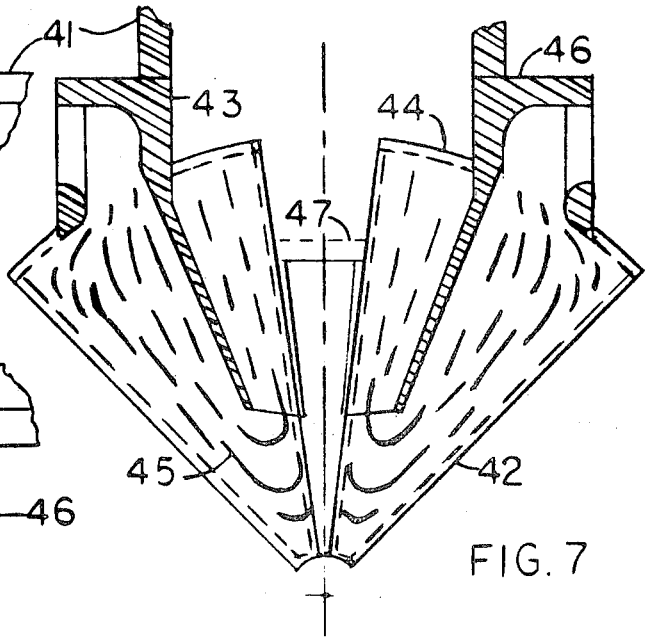
FIG. 7

ROTARY STIRLING ENGINE

BACKGROUND OF THE INVENTION

The Stirling cycle has long been regarded as an effective means of transforming heat energy into mechanical power. However, engine design has presented many problems in heat transfer, fluid displacement mechanisms, and effective seals, which generally resulted in costly designs with low overall effeciency and low power to weight ratios.

Since increasing demands from society for electrical and mechanical power, and the realization that the existing petroleum reserves may not be sufficient to meet even the needs of the existing generations' fuel requirements at the present rates of increase; and since we are fast approaching the limits of our environment to absorb the polutants produced by internal combustion engines, it has become evident that more power must be provided from other sources such as geothermal, solar, nuclear and other nonpolutant sources of heat. Therefore, much research has been generated in the development of Stirling engines as a means of producing mechanical power from any heat source independent of polutants, if any, from the source.

The object of this invention is to provide a novel means of transferring heat and fluids within a Stirling cycle engine whereby the efficiency and power to weight ratio of the engine will be increased, while simplifying its construction and reducing costs. The prior art includes various pump, motor, and compressor configurations, which may bear a superficial resemblance to this invention. However, such devices do not provide for the displacement arrangement required for the Stirling cycle sequence, do not recycle the system working fluids within the apparatus nor use the motoring elements as heat exchangers. It will be shown that the concept is equally applicable from micro-watt solar engines to mega-watt nuclear power generators within the physical construction limitations and structural integrity of the heat exchangers.

SUMMARY OF THE INVENTION

A Stirling cycle engine utilizing a variable displacement mechanism consisting of two spherical wedge shaped rotors, covered with heat conducting fins and mounted on intergral support shafts mounted nonlinearly within a spherical housing, and connected at 90° to each other through a disk-like universal type coupling, each side of which is also covered with fins complementary to the rotors and, which with the rotors, divide the housing into four separate chambers. The chambers are interconnected through passages in the coupling into two pairs in which the volume of each pair varies with rotation of the shaft 180° out of phase with the other pair, and each of the interconnected chambers varies 90° out of phase with the other as the dividing disk rotates between the sectors in oscillating motion.

Each rotor and shaft contains passageways to allow heat conducting fluids to be pumped through the fins to provide for the rapid transfer of heat between the conducting fluids and working fluids within the chambers. The rotor coupling which rotates relative to the rotors in oscillating motion, with the coupling fins interspaced with the rotor fins displacing the working fluid from one chamber to the other, is constructed from porous heat-absorbing material to provide for the rapid transfer of heat to and from the working fluid, to function as a regenerator.

Means are provided for pressure regulation of the working fluids and movement of heat transfer fluids through the rotors.

DRAWING DESCRIPTION

FIG. 4 is a view of the rotor assembly in direction of view indicators 4—4 of FIGS. 2 and 3 with the rotor collar and cap omitted for clarity;

FIG. 5 is a sectional view of rotor assembly in direction of view indicators 5—5 of FIG. 4 with the rotor collar and cap added;

FIG. 6 is an end view of rotor assembly in direction of view indicators 6—6 of FIG. 5;

FIG. 7 is a sectional view through rotor in direction of view indicators 7—7 of FIG. 4 with the rotor collar and cap added;

DETAILED DESCRIPTION

The invention is illustrated and described in connection with structural embodiments of a simple configuration. As such, it will be apparent to those skilled in the art that certain of the mechanical and structural features described herein may be departed from in certain particulars without departing from either the spirit or scope of the invention. Moreover, although this engine is described in relation to an engine of the character mentioned, it will additionally become apparent that it is also adaptable for use as a heat pump since the process is reversible.

Figure 1:
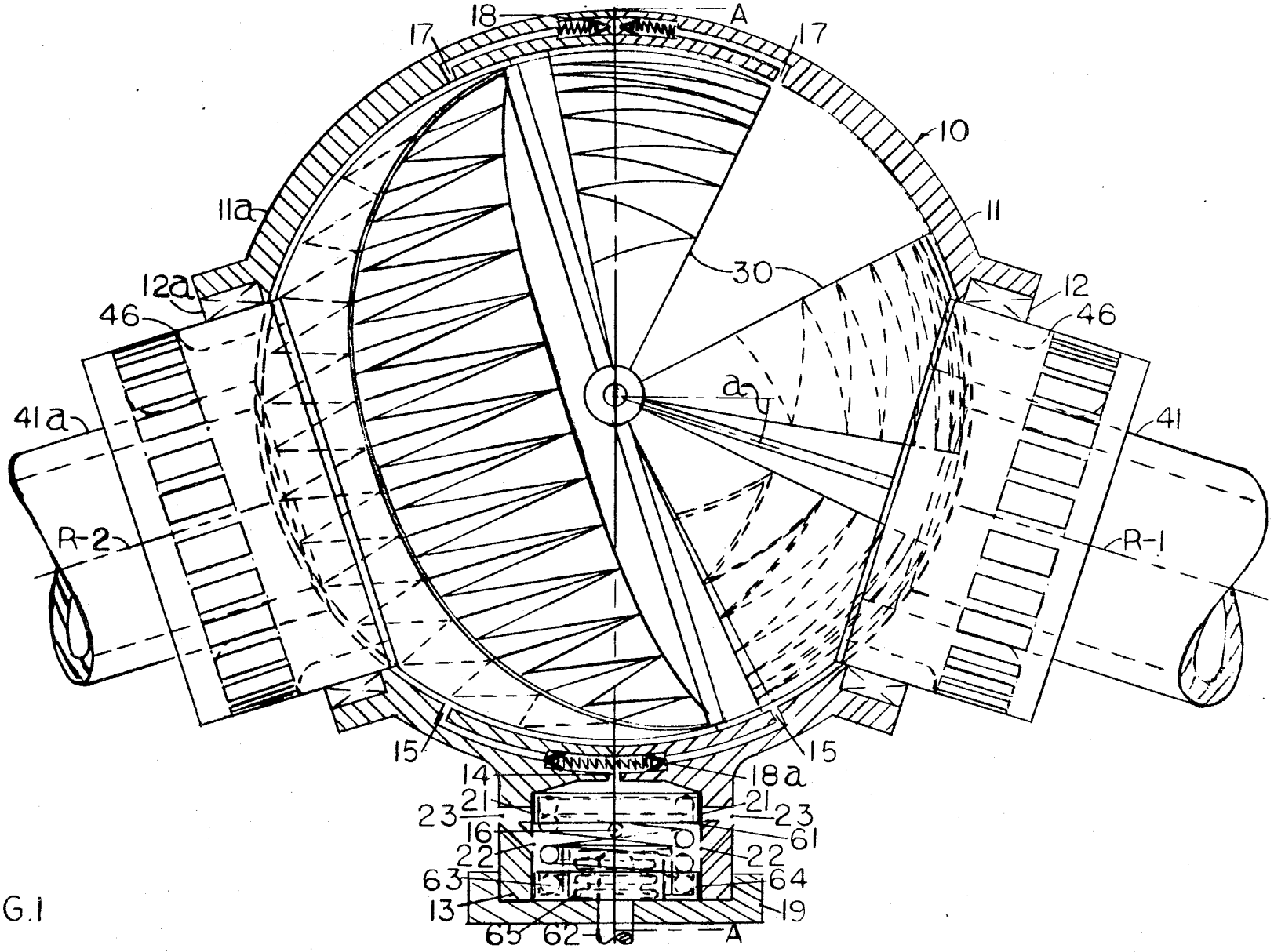
FIG. 1 is a side view taken perpendicular to a plane of symmetry of the engine which includes the centerline of the rotor support shafts, with the housing shown in section only, to allow exposure of the working components. The view is semi-schematic and includes a pressure regulating valve.

Referring first to FIG. 1 of the drawings, the numeral 10 generally refers to the entire basic engine which is symmetrical longitudinally about a plane including the input/output shafts 41 and 41*a*. The primary housing means or casing elements 11 and 11a of engine 10 are hemi-spherical in shape and are flanged along a line of symmetry A—A for joining and sealing by conventional means of bolting and gaskets (not shown), to effect a seal plane around the periphery of the join. The housings 11 and 11a contain and support the engine motoring elements hereinafter referred to as the rotor-coupling assembly 30, of which the support shafts 41 and 41*a* are suitable journaled in housing support bearings 12 and 12*a* located nonaxially so that the shaft axes R-1 and R-2 pass through the center of the sphere at an angle *a* (FIG. 1) to a line perpendicular to the housing plane of symmetry A—A. It will be shown that the angle *a* is a design variable determined by heat transfer and fluid flow requirements. Inasmuch as the inner spherical surfaces of the housings 11 and 11a are wiped by the rotor-coupling assembly 30 housed therein, the entire inner surface shall be ground and honed and treated with dry lubricants to effect a suitable seal plane. The housings 11 and 11a also contain an engine pressure regulator valve chamber 13, which is connected by integral passageways from a valve inlet port 14 to engine high pressure outlet ports 15 and from a valve outlet port 16 around the flanged periphery to engine low pressure inlet ports 17. Check valves 18 and 18*a* are located in the passageways to prevent reverse or crossflow between the ports. Suitable spaced differential control ports 21 and 22, which are valved by the positioning of a pressure regulating piston 61, are connected to reference pressure ports 23. A pressure control rod 62 slidable mounted in an enclosure cover 19, and sealed by bellows 65, varies the compression of a differential pressure regulating spring 63 through the positioning of a spring retaining cup 64. The enclosure cover 19 is suitable attached to the housings to seal the enclosure.

Figure 2:
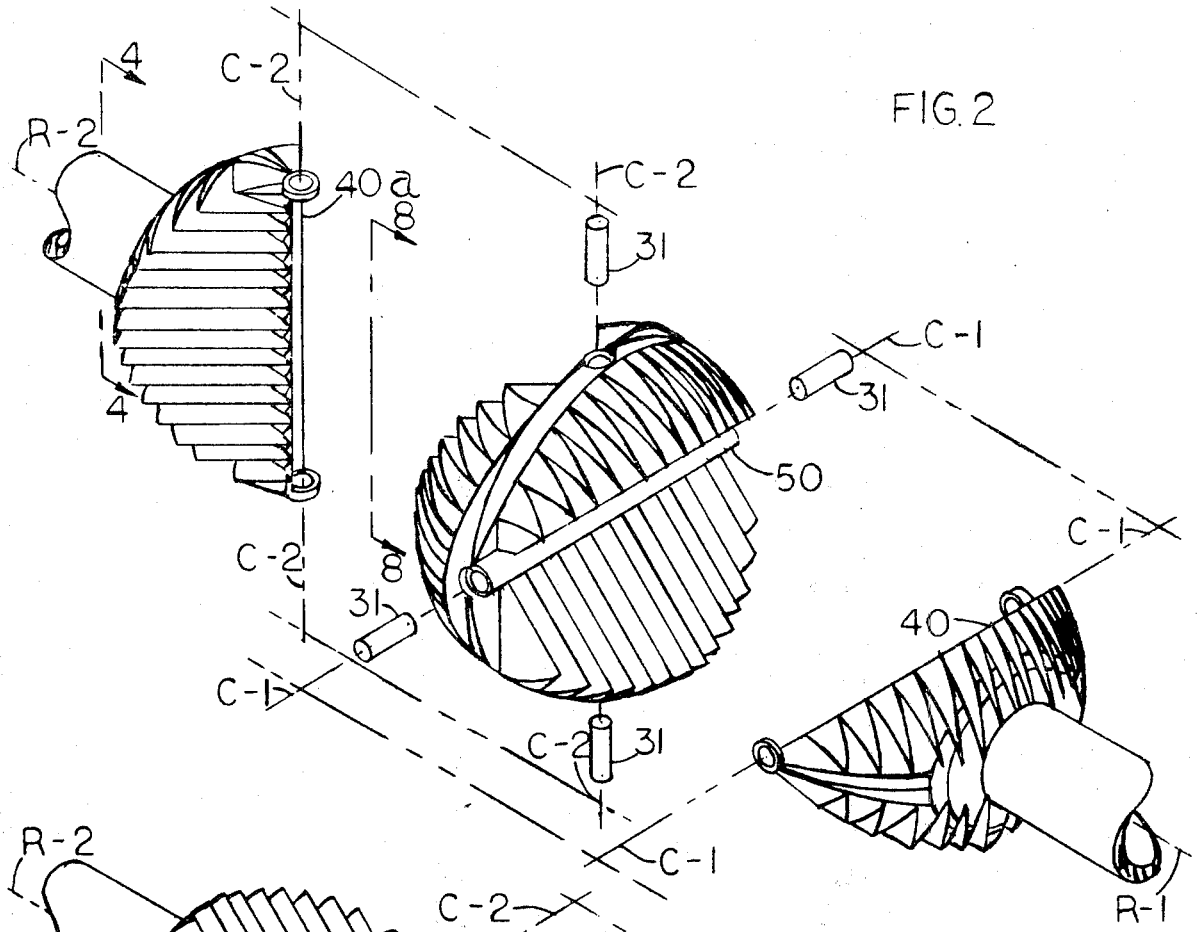
FIG. 2 is an exploded isometric view schematically showing the relationship of the motoring elements and interspacing of heat exchanger fins, with the spherical housing, rotor caps and rotor collars omitted for clarity.
Figure 3:
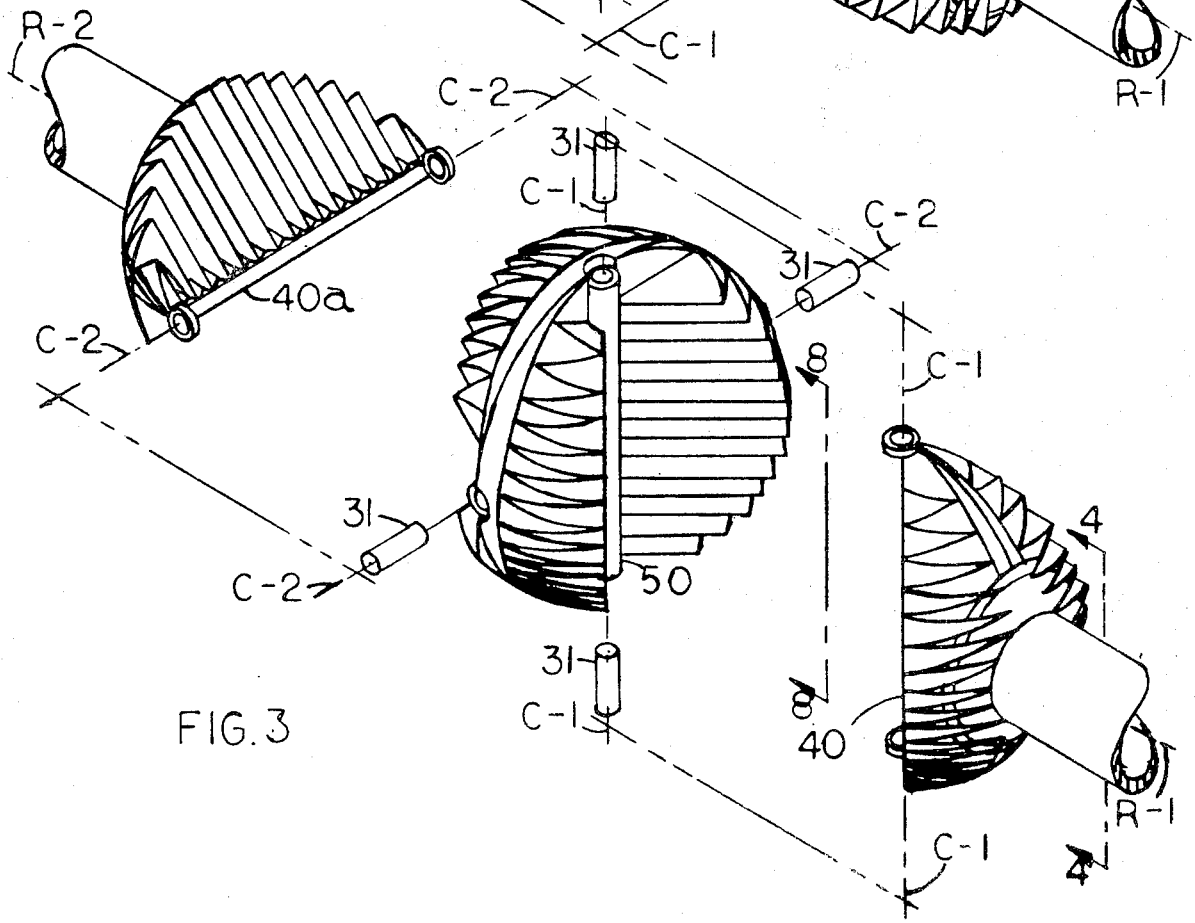
FIG. 3 is similar to FIG. 2 except the assembly has been rotated through 90° to illustrate symmetry.
Figure 8:
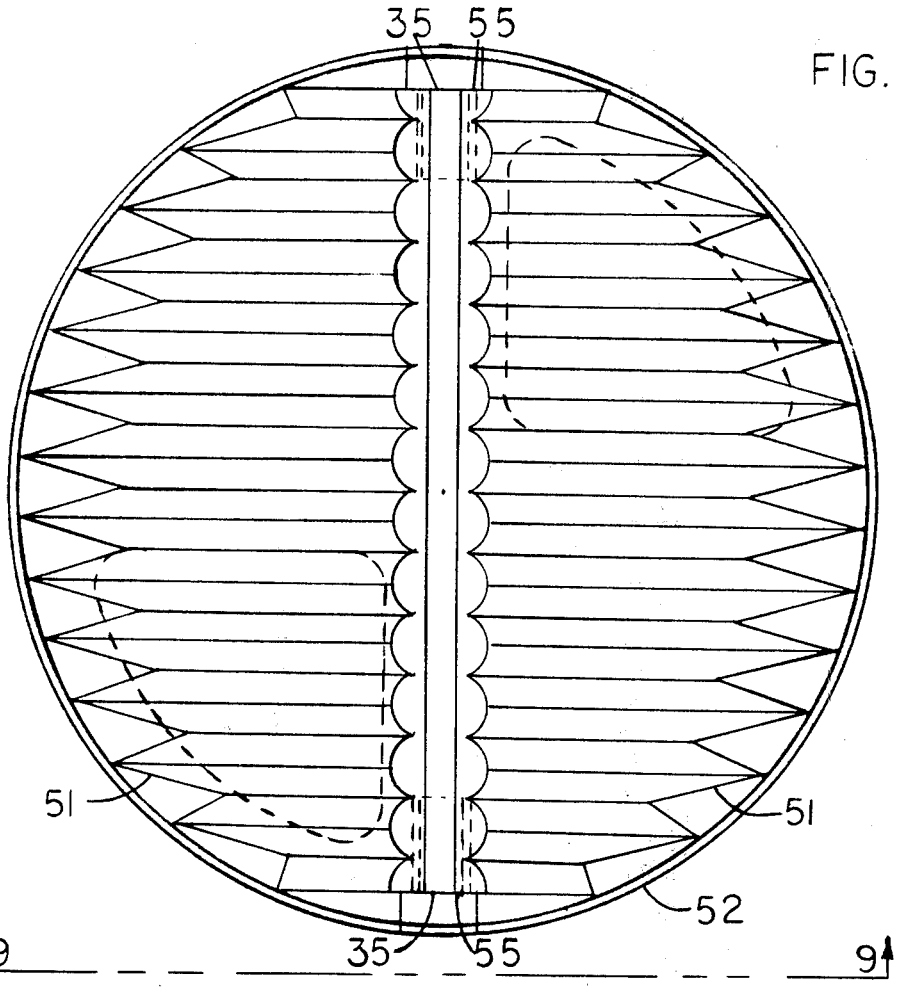
FIG. 8 is a view of coupling assembly in direction of view indicators 8—8 of FIGS. 2 and 3.
Figure 9:
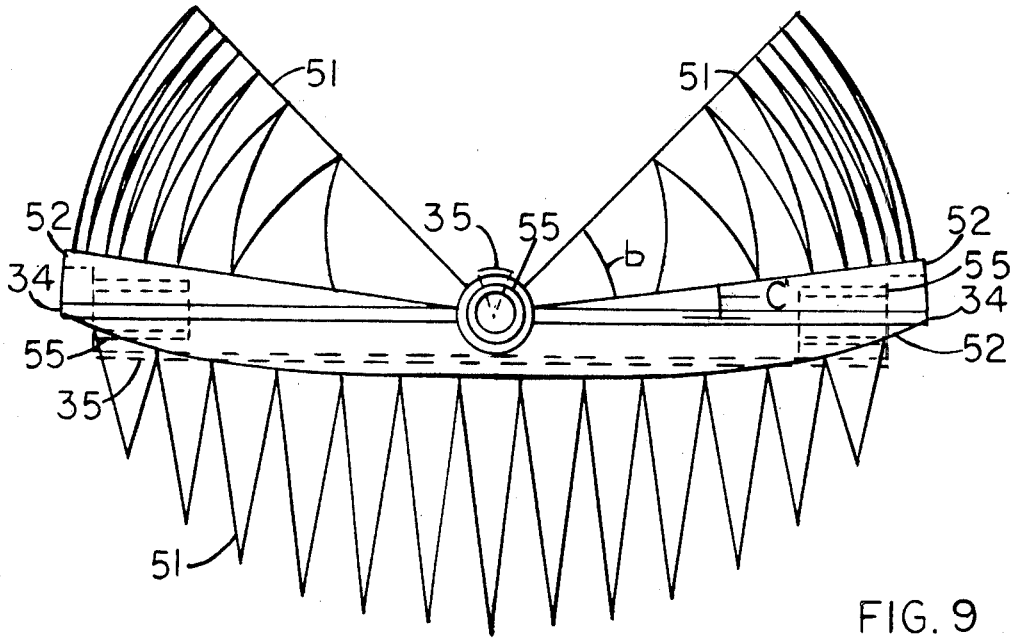
FIG. 9 is a view of coupling assembly in direction of view indicators 9—9 of FIG. 8.

The rotor-coupling assembly 30 is shown in FIGS. 2 and 3, removed from the engine housing for clarity. The assembly consists of two substantially identical rotor and shaft assemblies 40 and 40*a*, a coupling assembly 50, and four connecting pivot pins 31.

The vertical connection between the left rotor assembly 40*a* and the coupling assembly 50 through pivot pins 31 as shown in FIG. 2, will rotate the coupling assembly counter-clockwise with respect to the right rotor assembly 40 about the horizontal coupling axis C-1 when the shaft axis R-1 and R-2 are inclined downward from the center of the coupling assembly 50 as shown in FIG. 1. Rotating the coupling assembly 50 counter-clockwise with respect to the right rotor assembly 40 will decrease the space between the rotor and coupling on the lower side of the assemblies and increase the space on the upper side. The space between the left rotor assembly 40a and coupling assembly 50 on the near and far side of the coupling axis C-2 will be substantially equal.

Similarly, with the rotor coupling assembly 30 rotated 90° to the position shown in FIG. 3 and the shaft axis R-1 and R-2 inclined to the position shown in FIG. 1, the right rotor assembly 40 connecting pins 31 will rotate the coupling assembly 50 clockwise about the left rotor assembly 40*a* axis C-2. Rotating the coupling assembly clockwise will decrease the space between the left rotor and coupling on the lower side and increase the space on the upper side. The space between the right rotor assembly 40 and the coupling assembly 50 on the near and far side of the coupling axis C-1 will be substantially equal.

Rotating the assembly 90° further will return the coupling assembly 50 counter-clockwise with respect to the right rotor assembly 40 to a position similar to FIG. 2 in which the spaces have been displaced 180°, with the original minimum space between the lower side of the right rotor assembly 40 and the coupling assembly 50 becoming the maximum space on the upper side and the original maximum space on the upper side becoming the minimum space on the lower side, while the spaces between the left rotor assembly 40*a* and the coupling assembly 50 on the near and far sides of the coupling axis C-2 are returned to equal spaces.

From the foregoing it has been shown that the rotation of the rotor-coupling assembly 30 will oscillate the coupling assembly 50 with respector to the rotor assemblies 40 and 40*a* to vary the volume of the space bounded by the engine housing, and the opposing faces of the rotor and coupling assemblies. It has also been shown that the volume of the spaces bounded by opposite sides of the coupling vary 90° out of phase with each other, and the volume of the spaces bounded by opposite sides of the rotors vary 180° out of phase with each other.

For clockwise engine rotation the space between the lower side of the right rotor assembly 40 and the coupling assembly 50 as shown in FIG. 2 is connected through passages in the coupling to the space between the far side of the left rotor assembly 40*a* and the coupling assembly 50. Similarly the space between the upper side of the right rotor assembly 40 and the coupling assembly 50 is connected to the space between the near side of the left rotor assembly 40a and the coupling assembly 50. Thus it can be appreciated that a fluid contained within the spaces between the rotors and couplings will be displaced from one of the interconnected spaces to the other as the shaft is rotated, and that it can be further appreciated for clockwise rotation the 90° phase lag between the interconnected chambers will cause the majority of the fluid to be contained within the right side chamber of the interconnected pair when the total volume of the pair is expanding and to be contained within the left side chamber of the interconnected pair when the total volume of the pair is contracting. Supplying heat to fluids contained in the right side expanding chambers and removing heat from fluids contained in the left side compressing chambers would fulfill the basic requirements for a Stirling cycle machine and work could be performed by the apparatus.

The construction of the rotor-coupling assembly 30 provides means for transferring heat to and from the fluid within the chambers. The rotor assembly 40 is symmetrical about a plane through the rotor and coupling axis R-1 and C-1, and consists of two finned heat exchangers 42, an exchanger support structure 43 and a shaft 41 (FIGS. 4, 5, 6 and 7). The heat exchanger 42 is a wedge shaped spherical sector made from an assembly of close tolerance castings having a plurality of connected thin walled hollow sector shaped fins with internal support webbing 45 and covered with a thin fin stabilizing cap 44. The exchanger support structure 43 is a cast or forged fitting consisting of a collar 46 attached to the end of shaft 41, and having inner and outer yokes 47 and 48 respectively, extending from each side forming fluid conducting passages or manifolds between the fin structures 42, terminating in a juxtaposition forming a pivot hub 49 for the pivot pins 31. The collar 46 also contains a circular manifold and openings to connect the fin passages to impeller outlets around the periphery of the collar. The exchanger 42, support 43 and shaft 41 are all welded together to form one part and seals 32 and 33 are installed on the outer yoke 48 and collar 46 respectively to complete the assembly.

The coupling assembly 50 is symmetrical about a plane through the coupling axes C-1 and C-2, having each half displaced 90° to the other, and each half symmetrical about each of the axes, and consists of four regenerators 51 and an insulating join plate 52 (FIGS. 2, 3, 8 and 9). The regenerators are thin, porous, wedge shaped spherical sectors made from close telerance sintered powdered pressed metal with a plurality of thin hollow sector shaped fins connected to a common manifold, which are complementary to and mate with the fins on the rotor heat exchangers 42. The join plate 52 is a circular disk containing holes arranged to connect the regenerator 51 manifolds into two interconnected pair. The plate and regenerators are welded together to form one part. Seal 34 is installed around the periphery of plate 52, seal 35 is installed between the centerline join of the regenerators 51, and coupling pin bushings 55 are installed to complete the assembly. The fin sector angle *b* and the manifold wedge angle *c* and *c'* of the heat exchanger 42 and regenerator 51 fins are design variables which are determined by heat transfer and fluid requirements.

Referring to FIG. 1 the engine operation is described assuming a high temperature transfer fluid is ducted to the right side rotor shaft 41 and a low temperature transfer fluid ducted to the left side rotor shaft 41*a*, with means for circulation of the fluids through the rotors, and means of torque transmission connected to either or both shafts with a positive torque output as clockwise looking from right to left. These conditions are arbitrary by design and selected here only for terms of reference. The engine is started by applying positive torque through the rotor shafts and circulating the heat transfer fluids through their respective heat exchangers 42.

Select for a reference position the chamber on the lower side of the right rotor assembly 40, which is connected through the coupling assembly 50 to the chamber on the far side of the left rotor assembly 40*a* for clockwise rotation. The total volume of these interconnected chambers at this point is less than one-third of their maximum displacement with the bulk of the fluid located on the left side of the coupling 50, with the heat from fluid compression being transferred to the left rotor heat exchanger 42*a*. Rotation through the next 45° will further compress the fluid to less than one-fifth its maximum volume while the movement of the coupling assembly 50 away from the right rotor assembly 40 will have displaced half of the fluid into the right side of the chamber, raising the temperature and pressure as heat is transferred from the regenerator 51. From this point as the remaining fluid is transferred to the right side of the chamber and heat is transferred from the right side rotor heat exchanger 42 to the fluid, the fluid pressure will drive the rotor-coupling assembly 30 clockwise towards the chambers' maximum desplacement position, until the chamber occupies the position shown on the upper side of the right rotor assembly 40 and the near side of the left rotor assembly 40*a*, with the chamber expanded to more than three-quarters of its maximum displacement. As the rotor coupling assembly 30 rotates through the chambers' maximum displacement the movement of the coupling assembly 50 towards the top side of the right rotor assembly 40 will transfer fluid to the left side chamber. The temperature of the fluid is again lowered as heat is transferred to the regenerator 51, and heat generated by fluid compression is transferred to the left side rotor heat exchanger 42*a* as rotor-coupling assembly 30 is driven to the original reference position by the chamber on the opposite side of the assembly passing through its minimum displacement position and the momentum of the mechanism.

Since the variation in displacement between the chambers on opposite sides of the rotor assemblies 40 and 40*a* are 180° out of phase and the total displacement of the sphere is fixed, the average starting volume of the fluid would be one-half of the maximum displacement of each chamber. Therefore, as the rotor is motored, the fluid pressure sensed at the chamber maximum displacement position by the engine low pressure inlet ports 17 would be less than that sensed at the engine differential pressure reference port 23, and working fluid would be drawn in through the regulator low pressure inlet port 22 through valve outlet port 16 and check valves 18 into the chamber through ports 17. The engine will accelerate as the working pressure continues to rise until the pressure sensed at the engine high pressure outlet ports 15 and applied through the check valves 18*a* and regulator port 14 to the regulator piston valve 61 exceeds the reference pressure on the opposite side of the piston by the amount required to overcome the differential pressure regulating spring 63, moving the valve to close the valve outlet port 16. At this point the engine will continue to accelerate and surplus fluids dumped through differential pressure control port 21 until equilibrium is reached between the differential rate of heat transfer through the heat exchangers and the equivalent power required to overcome the applied negative torque to the output shaft plus the internal pumping resistance, at which point the piston would move to the neutral position covering both ports 16 and 21. Applying pressure to engine control rod 62 will increase the engine differential pressure increasing the engine speed or torque within the limits of the heat exchangers, and releasing the rod will allow the engine to restore the equilibrium for idle as determined by the pre-set compression on the regulator spring 63. Applying braking torque to the output shaft 41 in excess of the output torque without applying pressure to the control rod 62 will raise the working fluid pressure allowing the regulator to dump fluid while slowing the engine speed, and reducing the amount of heat transfer fluids supplied to the rotor heat exchangers 42 will further reduce torque and engine speed until the engine is stopped and no heat is being transferred.

Although minor seal leakage is inconsequential to engine operation due to automatic pressure regulation and distribution, seal leakage between the rotor collar 46 and the housing 11 would limit the working fluid to an expendable supply, such as air limited to a fairly low range of pressures and temperatures (approx. 10 atmos. and 500° F max.). Nonrecirculation of transfer fluids would also limit the heating fluids to expendable flue gases and the cooling fluids to air. Since engine output is approximately proportional to the rate of heat transfer and fluid working pressures, engine efficiency and performance would be improved by adding an optional secondary housing 101 (FIG. 10), extending from the primary housing 11 on each end to contain a common fluid for both working and transfer functions having improved characteristics, and pressurized to increase the engine base or reference pressure while reducing seal requirements and allowing higher operating temperatures. The enclosures which have valve provisions (not shown) for fluid charging and relieving, are connected to external heat exchangers through duct connections 102 and 103, and to the rotor heat exchangers through holes in the rotor shaft 41. The enclosed fluid is recirculated by a fluid impeller 70 mounted on the rotor collar 46 so that the amount of heat transfer fluids circulated, and heat transferred, increases with engine speed.

The shaft 41 is supported by bearing 104 and may be directly coupled for torque transmission to a shaft extension 105 extending through a conventional seal chamber 106. Limiting the shaft extension and seal to the low temperatures side of the engine and using moderately heavy working transfer fluids would enable working pressures and temperatures to be raised to a more moderate range, (approx. 50 atmos. and 700° F max.).

Figure 11:
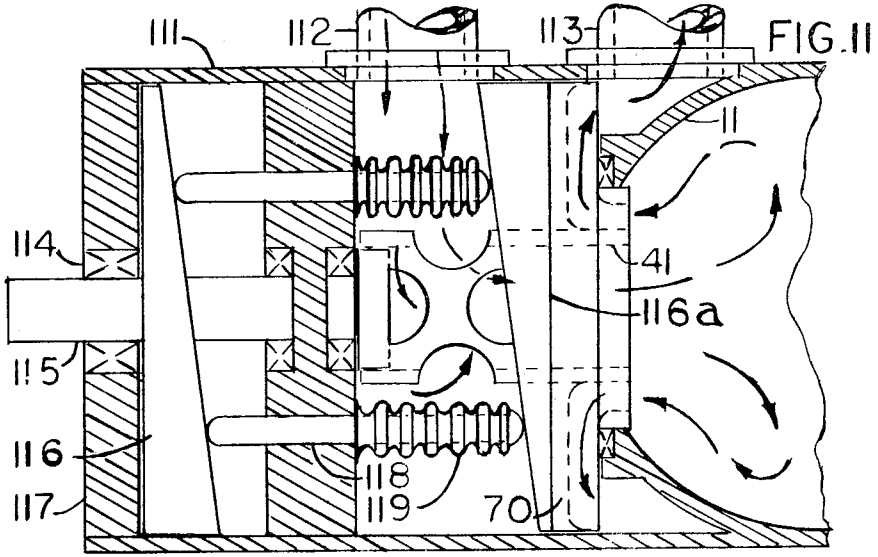
FIG. 11 is a partial schematic view similar to FIG. 10 of an optional secondary housing except indirect transmission through a swash plate coupling with bellow seals has been added.
Figure 10:
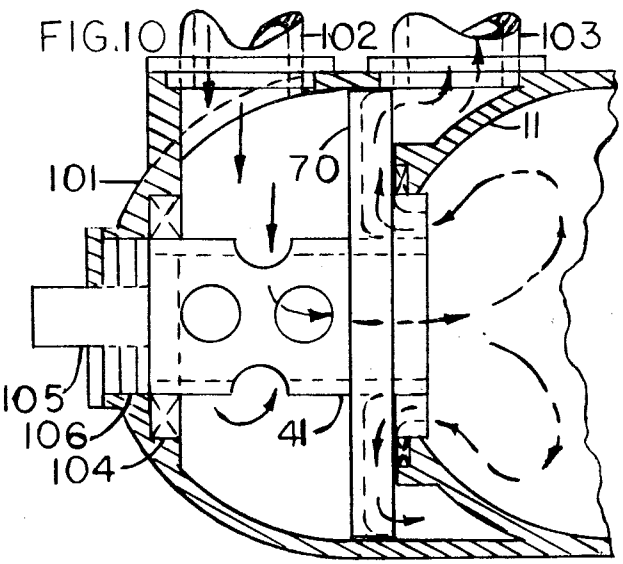
FIG. 10 is a partial schematic view of an optional secondary housing extending from the end of the primary housing in the same plane as FIG. 1 for use with external heat exchangers for the heat transfer fluids.
Figure 12:
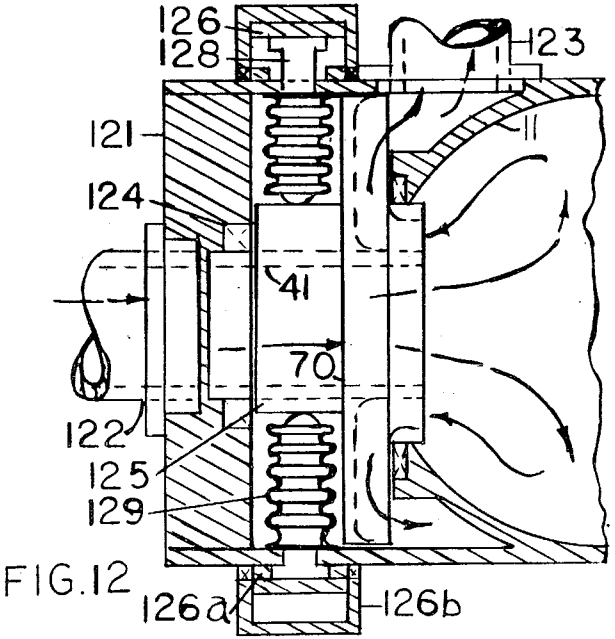
FIG. 12 is a partial schematic view similar to FIG. 10 of an optional secondary housing except indirect transmission through excentric cam and gear coupling with bellow seals has been added.

Further improvements in engine efficiency and performance could be obtained by adding an optional secondary housing 11 (FIG. 11) with inlet/outlet connections 112/113 respectively, similar to FIG. 10 except the output shaft rotary seal 106 is eliminated by coupling the mechanical output indirectly through complementary swash plates 116 and 116*a* mounted on shaft 41 and on an external secondary shaft 115 in housing extension 117 rotatably supported by bearing 114 in line with shaft 41 and driven by connecting slider pins 118 sealed by bellows 119. FIG. 12 illustrates a similar arrangement to FIG. 11 with extended housing 121 and fluid inlet/outlet ports 122/123 respectively, except the mechanical output is indirectly coupled through eccentric cam 125 mounted on output shat 41 to eccentric ring gear 126 internally meshed with fixed ring gears 126*a* and externally meshed with rotatably mounted ring gear 126*b*, and driven by eccentric slider pins 128, sealed by bellows 129. Limiting these arrangements to the low temperature side of the engine with medium to light working/transfer fluids would enable working pressures and temperatures to be raised to a fairly high range, (approx. 150 atmos. and 1000° F max.) by utilizing cooling transfer fluid bleed through the support bearings on the hot side.

Figure 13:
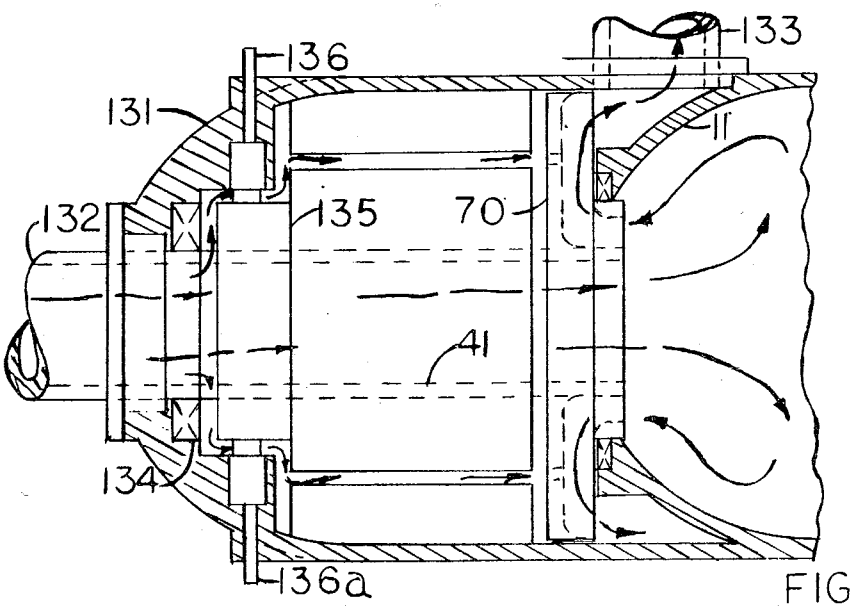
FIG. 13 is a partial schematic view similar to FIG. 10 of an optional secondary housing except a secondary coupling using a motor-generator has been added.

Finally by adding an optional secondary housing 131 (FIG. 13) with inlet/outlet ports 132/133 respectively, similar to FIG. 10 except the mechanical coupling has been eliminated by using a secondary transmission through a motor-generator 135, electrical coupling mounted on output shaft 41 with sealed output terminals 136 and 136*a*, eliminating the transmission seals. Engine working pressures and temperatures for light gases (helium/hydrogen) may be raised to an extremely high range, (pressures in excess of 200 atmospheres) limited only by the structural integrity of the engine system, including the external heat exchangers with temperatures limited by the motor-generator and bearing cooling requirements.

Figure 15:
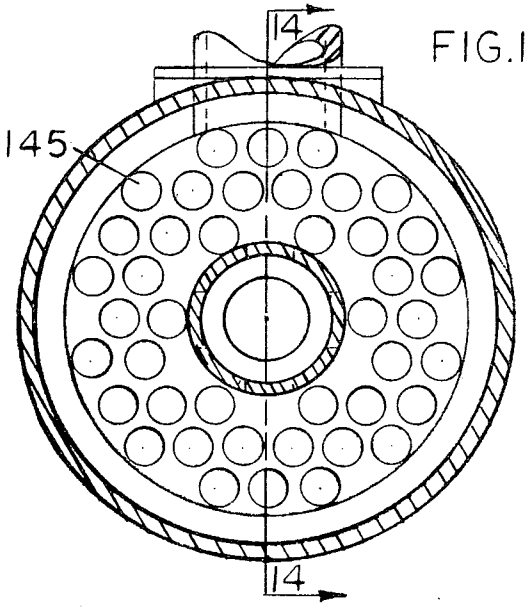
FIG. 15 is a sectional view through the secondary housing and internal heat exchanger in the direction of view indicators 15—15 of FIG. 14.
Figure 17:
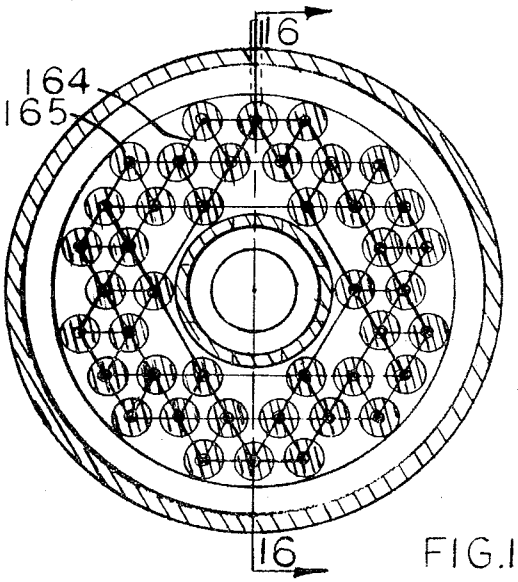
FIG. 17 is a sectional view through the secondary housing and internal heat source.
Figure 14:
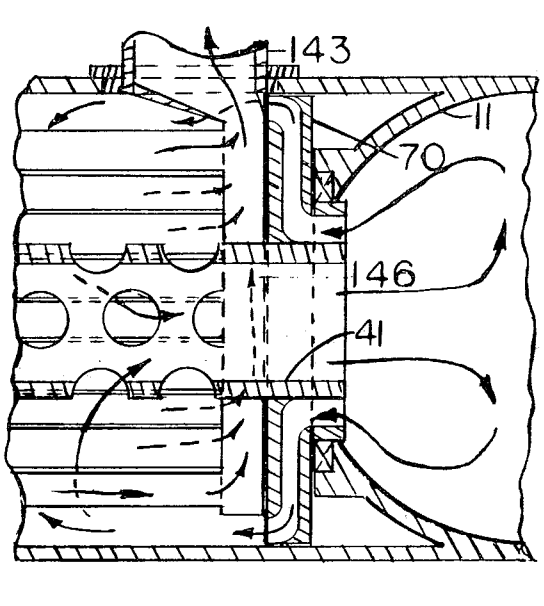
FIG. 14 is a partial schematic view similar to FIG. 10 of an optional secondary housing except an internal heat exchanger has been added for use with a secondary heat transfer fluid.
Figure 16:
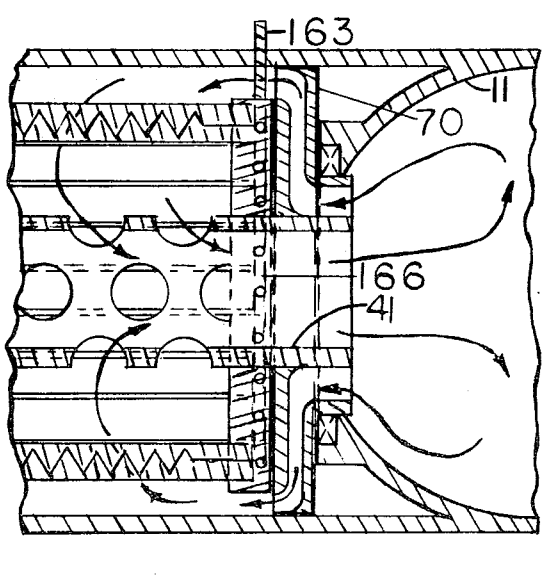
FIG. 16 is a partial schematic view similar to FIG. 10 of an optional secondary housing except an internal heat source has been added in place of the external heat exchangers.

The danger of exposing light flammable gases such as hydrogen at extreme pressures and temperatures in an external heat exchanger may be avoided by utilizing internal heat exchangers for the primary working/transfer fluids coupled to external heat exchangers through a secondary transfer fluid. FIG. 14 illustrates an optional secondary housing 141 (FIG. 14) similar to FIG. 10, except secondary heat transfer fluids are circulated through the inlet connection 142, through a secondary transfer fluid inlet manifold 144, heat transfer tubes 145 and outlet manifold 146 to outlet connection 143. The primary heat transfer fluid is circulated by the fluid impeller 70 around the outer periphery of the heat exchanger tubes, between the heat exchanger transfer tubes 145 (see FIG. 15) and through holes in the rotor output shaft 41 to the rotor heat exchanger 42. Similarly an internal heat exchanger may be used with an internal heat source in place of the secondary fluid as illustrated in FIG. 16, wherein an optional secondary housing 161 encloses heat transfer tubes 165 filled with solid material brought to the molten state by heat supplied by heating elements 167 located in or in close proximity to the cylinders and connected on each end by bus bar networks 164 and 165 to sealed electrical terminals 162 and 163. The latent heat of fusion on resolidifying of the material will maintain the exchanger at constant temperature until all the material is solidified. The heat transfer fluid is circulated by the fluid impeller 70 around the periphery and between the heat exchanger tubes 165 (see FIG. 17) and through holes in the rotor 41 to the rotor heat exchanger 42.

Obviously a complete engine installation may use any of the foregoing supplementary housing configurations in combination, or in conjunction with variations in engine coupling of the basic assembly in tandem or parallel arrangements to meet specific installation objectives. Design parameters affecting engine performance and efficiency include the rate of heat transfer through the rotor heat exchangers, which is governed mainly by the temperature of the heat transfer fluids (operating temperatures) and the construction of the heat exchangers, (including fin area, thickness and material) fluid operating pressures, fluid characteristics, (including density, viscosity, conductivity and gas constants) engine displacement, compression ratio and rotational speed. The engine is approximately scaleable with power output varying by the cube of the scale except for the heat exchanger fin spacing, which must remain constant if the same ratio of heat exchanger capacity to engine volume is to be maintained.

A first approximation of engine capacity may be obtained by using the following symbols in defining the engine geometry and operating conditions, wherein:

$a$ = Angle between line through center of housing perpendicular to flange plane, and centerline of rotor shaft, in degrees.

$b$ = Angle subtended by rotor and coupling fins, in degrees.

$c$ = Angle subtended by rotor manifolds, in degrees.

$c'$ = Angle subtended by coupling manifolds, in degrees.

$d$ = Engine reference angle from position shown in FIG. 1, in degrees.

$k$ = Thermal conductivity of rotor heat exchanger, in BTU per hour per square ft. per degree F per ft.

$r$ = Radius from center of coupling pivot to center of pressure of coupling area A, in ft.

A = Cross sectional area of rotor and coupling sectors, in sq. ft.

$Fs$ = Fin spacing, in ft.

$Ft$ = Fin wall thickness, in ft.

H = Heat dissipation factor, in percent.

$Ld$ = Torque at reference angle $d$ from one pair of chambers, in ft. lbs.

$Ldt$ = Total torque at reference angle $d$ from both pair of chambers, in ft. lbs.

$Pd$ = Chamber pressure at reference angle $d$, in lbs./sq.in.

Pi = 3.142

$Pr$ = Regulator pressure sensed at high pressure port, in lbs./sq. in.

Q = Quantity of heat transferred through heat exchanger, in BTU per hour.

R = Radius of rotor and coupling sectors through centerline, in feet.

$Sa$ = Length of angular stroke of center of pressure of area A, in ft.

T1 = Low temperature of working fluid, in degrees R.

T2 = High temperature of working fluid, in degrees R.

$Td$ = Chamber working fluid average temperature at reference angle $d$, in degrees R.

$Te$ = Differential temperature across heat exchangers, in F°.

$Vr$ = Volume of fluid contained within coupling regenerators connecting two chambers, in cu. ft.

$Vhd$ = Volume of high temperature chamber at engine reference angle $d$, in cu. ft.

$Vld$ = Volume of low temperature chamber at engine reference angle $d$, in cu. ft.

Vmax = Maximum volume of one chamber, in cu. ft.

$Vtd$ = Total volume of one pair of chambers including connecting regenerator Vr at reference angle $d$, in cu. ft.

which have the following relationships:

$$a = \frac{90 - (b + c + c')}{2} \quad ; \quad A = \frac{Pi \cdot R \cdot R}{2}$$

$$Sa = \frac{a}{90} \cdot 2Pi \cdot r \; ; \qquad r = \frac{4R}{3Pi}$$

$$Vmax = \frac{a}{90} \cdot \frac{4}{3} Pi \cdot R \cdot R \cdot R = Sa \cdot A$$

$$Vr = \frac{1}{2} \cdot \frac{90 - 2a - c}{360} \cdot \frac{4}{3} Pi \cdot R \cdot R \cdot R$$

$$Vhd = \frac{Vmax}{2} \cdot \frac{1 - \cos d}{}$$

-continued $$Vld = \frac{Vmax}{2} \cdot \frac{1 - \sin d}{}$$

$$Vtd = Vhd + Vld + Vr$$

$$Pd = \frac{2\,Pr \cdot Td}{Vtd} \cdot \frac{(.293\,Vmax + Vr)}{T1 + T2}$$

$$Ld = 72\,Pd \cdot A \cdot Sa\,(\sin d - \cos d)$$

$$Ldt = Ld + L\,(d + 180)$$

$$Q = \frac{H \cdot k \cdot b \cdot R \cdot R \cdot R \cdot Te}{20 \cdot Fs \cdot Ft}$$

$$Td = \frac{1}{Vtd} \cdot \left(Vld \cdot T1 + Vhd \cdot T2 + Vr \cdot \frac{T1 + T2}{2}\right)$$

For purpose of illustration assume a basic engine with a two foot housing I.D. (R=1), in which $a$=15°, $c$=$c'$=5°, fin spacing is 1 inch (Fs=1/12), fin wall thickness is one quarter inch (Ft=1/48) and fin material is copper with $k$=230. Further assume, that for the displacement to fin area ratio, and the engine reference or charging pressure selected, the working fluid heat transfer characteristics are capable of holding the chamber temperatures within 150 F° of their respective heat exchangers. Provide a source of transfer fluids at temperatures and flow rates to maintain the low temperature rotor heat exchanger below 400° F and the high temperature rotor heat exchanger above 1000°. This would translate to average working temperatures of 550° F in the compression chamber and 850° F in the expansion chamber. The assumed engine chamber displacements, average working temperatures, pressures and net torque values are shown in TABLE 1 for each pair of chambers at the reference angles noted, for the minimum and maximum limits of the regulated range, for a one atmosphere reference pressure, as computed by substitution in the preceding equations. Adding torque values and averaging to obtain a mean effective torque indicates a torque range of 41.25 to 117.5 ft. lbs. per atmosphere reference pressure which translates to 0.785 to 2.24 H.P./100 RPM/ATM. As the engine reference or charging pressures and speeds are increased, the temperatures and pressures will tend to be higher towards the end of the compression stroke and lower towards the end of the expansion stroke as the capacity of the heat exchangers approach their limits, effectively limiting the maximum output. The minimum output is limited when the engine high pressure is lowered to approach the reference pressure. Substitution in the heat transfer equation Q indicates that the heat exchangers are capable of conducting up to 1,400 BTU's per second using a 10% heat disapation factor, which translates to approximately 2,000 H.P., providing adequate heat flow. Therefore engine RPM and H.P. output will increase, as long as the braking torque does not exceed the engine output torque, until internal pumping loads and frictional losses restore equilibrium, with the heat transferred through the heat exchangers.

TABLE I

| ANGLE (d) | 0 | 45 | 90 | 135 | 180 | 225 | 270 | 315 |
|---|---|---|---|---|---|---|---|---|
| Vhd | 0 | .102 | .349 | .596 | .698 | .596 | .349 | .102 |
| Vld | .349 | .102 | 0 | .102 | .349 | .596 | .698 | .596 |
| Vr | .320 | .320 | .320 | .320 | .320 | .320 | .320 | .320 |
| Vtd | .669 | .524 | .669 | 1.018 | 1.367 | 1.512 | 1.367 | 1.018 |
| Td | 1082 | 1160 | 1238 | 1233 | 1198 | 1160 | 1122 | 1087 |
| Pd (Min.) | 10.7 | 14.7 | 12.3 | 8.04 | 5.82 | 5.09 | 5.50 | 7.09 |
| Ld (Min.) | −540 | 0 | 618 | 572 | 293 | 0 | 274 | 504 |
| Ldt (Min.) | −247 | 0 | 344 | 68 | −247 | 0 | 344 | 68 |

TABLE I-continued

| ANGLE (d) | 0 | 45 | 90 | 135 | 180 | 225 | 270 | 315 |
|---|---|---|---|---|---|---|---|---|
| Pd (Max.) | 31.1 | 42.5 | 35.5 | 23.3 | 16.8 | 14.7 | 15.8 | 20.5 |
| Ld (Max.) | −1563 | 0 | 1,784 | 1,656 | 844 | 0 | −794 | −1457 |
| Ldt (Max.) | −719 | 0 | 990 | 199 | −719 | 0 | 990 | 199 |

From the foregoing it will be recognized that an engine with unique structural, weight, size and efficiency characteristics of simple construction is encompassed, and that the features described above and claimed hereinafter are greatly improved over those of prior art of both reciprocating and rotary configurations of Stirling cycle engines, therefore;

I claim:

1. A rotary Stirling cycle engine with means for internal heat transfer, comprising:

a housing fixed against rotation and having spherical internal surfaces;

two support shafts of hollow construction rotatably mounted by bearing means located nonaxially in said housing between one and two right angles apart, the center-line of said shafts intersecting at a point coincident to the center of said housing;

a spherical wedge shaped rotor mounted on each said shaft having the wedge lune juxtapose to and in sealing contact with said housing interior;

said rotors having a plurality of hollow sector shaped fins arranged with the centerline of the sector radii perpendicular to said shaft centerline and connected by a common manifold to provide fluid passage through said shaft and fins;

a circular disk positioned between and rotatably connected to said rotors by bearing means located on two major diameters of the disk at right angles, to form a universal coupling with said rotors, and defining four separate chambers with displacement variable by the relative motion of the disk to the rotors, and having sealing engagement with said housing and rotors;

said disk having two sets of porous hollow fins on each side for complementary engagement with said rotor fins, each set of which is connected by a common manifold through passages in the disk to one of the sets on the opposite side, forming two interconnected pair of fin sets, each pair providing fluid passage between one pair of said chambers.

2. The rotary engine of claim 1 wherein:

the amount of working fluid contained within said housing is regulated by a valve system comprising;

a valve housing containing fluid ports connected by means defining fluid passageways to ports located on said engine housing inner surface in the proximity of each said chamber mid-position, where chamber volume is maximum, and where chamber volume is minimum, and to reference pressure ports on the outside of said engine housing;

valve means located in said passageways to allow fluid flow only to said maximum volume ports and only from said minimum volume ports;

valve means located in said valve housing to allow fluid flow from said reference pressure sources to said maximum volume ports only when fluid pressure from said minimum volume ports is less than the reference pressure plus a control spring bias pressure, and to allow fluid flow from said minimum volume ports to said reference pressure ports only when the pressure from the minimum volume ports is more than the reference pressure plus the control spring bias pressure, and in which fluid flow between said valve ports and said engine ports is stopped when the pressure from the minimum volume ports is in equilibrium with reference reference pressure plus the control spring bias pressure;

actuating means to reposition said control spring to vary said equilibrium pressures.

3. The rotary engine of claim 2 wherein:

secondary housings extending from said engine housings and enclosing said rotor shafts are added to provide a container for pressurizing and recirculating engine fluids, said secondary housings having;

bearing means positioned for rotatably supporting said rotor shafts;

duct connections suitably located for routing of heat transfer fluids to external heat exchangers;

valve means for charging transfer fluids into or relieving transfer fluids from said housings to enable setting fluids pressure within said housings;

a fluid impeller is mounted on and fixed to each said rotor shaft and connected by passage means to provide fluid circulation through said rotors and external heat exchangers.

4. The rotary engine of claim 3 wherein:

one of said secondary housings contain a circular chamber coaxial with the centerline of said rotor shaft through which a shaft extension attached to the rotor shaft for transmission of torque from the engine is rotatably sealed by seal means to restrict the loss of fluid from said housing.

5. The rotary engine of claim 3 wherein:

one of said secondary housings contain cam means attached to said rotor shaft to actuate a plurality of cam pins slidably mounted through the end of the housing concentric to the rotor shaft and sealed by bellows means to prevent leakage of fluid from the housing;

said secondary housing is further extended to support a secondary shaft rotatably mounted by bearing means in line with said rotor shaft outside of the sealed enclosure of said secondary housing;

cam means attached to said secondary shaft complementary to the cam means within the sealed enclosure is in slidable contact with and driven by the reciprocating motion of said cam pins, translating the motion of the rotor shaft to the secondary shaft.

6. The rotary engine of claim 3 wherein:

one of said secondary housings contain cam means attached to said rotor shaft to actuate a plurality of cam pins slidably mounted through the sides of said housing radial to the rotor shaft and sealed by bellows means to prevent leakage of fluid from the housing;

an external ring gear is attached to the periphery of said housing adjacent to said cam pins;

an internal/external ring gear is mounted over and in slidable contact with said cam pins and eccentrically meshed with said fixed ring gear;

an internal ring gear is concentrically mounted on said housing by bearing means and eccentrically meshed with said eccentrically driven gear translating the motion of the rotor shaft through a reduction ratio equal to the measure of twice the cam eccentricity compared to the concentric gear diameter.

7. The rotary engine of claim 3 wherein:

one of said secondary housings contain a motor-generator having the fixed portion mounted to the housing and the movable portion attached to said rotor shaft;

said secondary housing having electrical terminals and means defining electrical conductors to said motor-generator sealed to prevent fluid leakage.

8. The rotary engine of claim 3 wherein:

one of said secondary housings contain an internal secondary heat exchanger including secondary heat transfer fluids connected through said housing duct connections to an external heat exchanger, said internal exchanger being supported within the housing to allow free circulation of the primary heat transfer fluids around the exchanger elements by the fluid impeller.

9. The rotary engine of claim 3 wherein:

one of said secondary housings contain an internal heat exchanger including material of high heat capacity, said exchanger being supported within the housing to allow free circulation of the heat transfer fluids around the exchanger elements by the fluid impeller and said secondary housings having electrical terminals in place of said duct connections and means defining electrical conductors to heating elements located within or in close proximity to said heat storage materials.

* * * * *